US006747213B2

(12) United States Patent
Bonicel

(10) Patent No.: US 6,747,213 B2
(45) Date of Patent: Jun. 8, 2004

(54) STRUCTURALLY-REINFORCED CABLE FOR TRANSPORTING POWER AND/OR FOR TELECOMMUNICATIONS

(75) Inventor: Jean-Pierre Bonicel, Rueil Malmaison (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/448,606

(22) Filed: Nov. 24, 1999

(65) Prior Publication Data

US 2002/0027012 A1 Mar. 7, 2002

(30) Foreign Application Priority Data

Dec. 31, 1998 (FR) ..... 98 16710

(51) Int. Cl.[7] ..... H01B 7/18

(52) U.S. Cl. ..... 174/102 R; 174/106 R; 174/126.1

(58) Field of Search ..... 174/102 R, 106 R, 174/126.1, 128.1; 385/101

(56) References Cited

U.S. PATENT DOCUMENTS 4,006,289 A * 2/1977 Roe et al. ..... 174/102 R
4,723,832 A * 2/1988 Okazato et al. ..... 385/101
5,125,062 A * 6/1992 Marlier et al. ..... 385/101
5,213,905 A * 5/1993 Leger et al. ..... 148/529
5,495,547 A * 2/1996 Rafie et al. ..... 385/101
6,060,662 A * 5/2000 Rafie et al. ..... 174/106 R

FOREIGN PATENT DOCUMENTS

JP 60-255923 * 12/1985
JP 01 276507 A 11/1989
JP 2-284777 * 11/1990
JP 07 302518 A 11/1995

OTHER PUBLICATIONS

Laperrousaz, Des profiles en acier composite, L'Usine Nouvelle, Sep. 18, 1997, p. 67.

* cited by examiner

*Primary Examiner*—Chau N. Nguyen
(74) *Attorney, Agent, or Firm*—Sughrue Mion, PLLC

(57) ABSTRACT

A telecommunications or power transport cable is structurally reinforced by incorporating at least one reinforcing wire or armoring having one or more layers of wires. The cable includes at least one reinforcing wire or armoring wire and/or optionally a tube made out of a composite steel having a steel core of a standard type covered in a layer of stainless steel.

13 Claims, 1 Drawing Sheet

STRUCTURALLY-REINFORCED CABLE FOR TRANSPORTING POWER AND/OR FOR TELECOMMUNICATIONS

The present invention relates to cables for transporting power and for telecommunications, and that have been structurally reinforced by incorporating at least one reinforcing wire and/or armoring made up of one or more layers of wire.

BACKGROUND OF THE INVENTION

In conventional manner, numerous power transport cables and telecommunications cables are structurally reinforced in order to enable them better to withstand the physical stresses that might be applied to them in the medium in which they are installed. In overhead cables, this leads to one or more reinforcing wires being associated with the electrically conductive wires and/or with the light-transmitting waveguides in order to improve the performance of such cables in mechanical terms, and in particular in terms of breaking strength. In similar manner, it is conventional to provide mechanical reinforcement for land cables, in particular those which are designed to be buried, and also for underwater cables, by means of armoring made up of one or more layers of wires that are mechanically stronger than the electrically conductive wires and/or the transmission waveguides that the armoring surrounds.

The reinforcing wires and the armoring wires of power transport cables and of telecommunications cables can be made of stainless steel so as to take advantage of the mechanical qualities that can be obtained with such steels and also of their ability to withstand corrosion. A high degree of resistance to corrosion is essential, in particular for undersea cables which are placed in a corrosive medium, and also for underground cables and overhead cables that are subjected to difficult climatic constraints. Thus, document EP-A-710862 describes an undersea optical fiber cable having stainless steel reinforcing wires.

Nevertheless, the use of stainless steel for making reinforcing wires or armoring wires gives rise to a significant increase in the cost of such cables, and less expensive substitute solutions are therefore being sought.

It is known to replace stainless steel wires with other wires, in particular galvanized steel wires or steel wires protected by an aluminum coating, for the purpose of reducing cost. Nevertheless, the resulting resistance to corrosion is considerably less and the way hydrogen can be given off, particularly from galvanized steel wires, means that such wires cannot be used to make the cores of optical fiber cables for telecommunications.

OBJECT AND SUMMARY OF THE INVENTION

The invention therefore proposes a power transport cable or a telecommunications cable that is structurally reinforced by incorporating at least one reinforcing wire and/or armoring having one or more layers of wires.

According to a characteristic of the invention, the cable has at least one reinforcing or armoring wire made of composite steel having a steel core of standard type, and covered in a layer of stainless steel.

According to a characteristic of a variant of the invention, the cable has at least one layer of armoring constituted by composite steel wires.

According to a characteristic of a variant of the invention, the cable has at least one reinforcing wire or armoring wire constituted by composite steel sold under the registered trademark NUOVINOX.

According to a characteristic of a variant of the invention, the cable has a tube obtained from a sheet constituted by composite steel having a core of a standard type of steel covered in a layer of stainless steel.

According to a characteristic of a variant of the invention, the cable has a tube constituted by a composite steel sold under the registered trademark NUOVINOX.

BRIEF DESCRIPTION OF THE DRAWING

The invention, its characteristics, and its advantages are described in the description below with reference to the following figures.

MORE DETAILED DESCRIPTION

Figure 1:
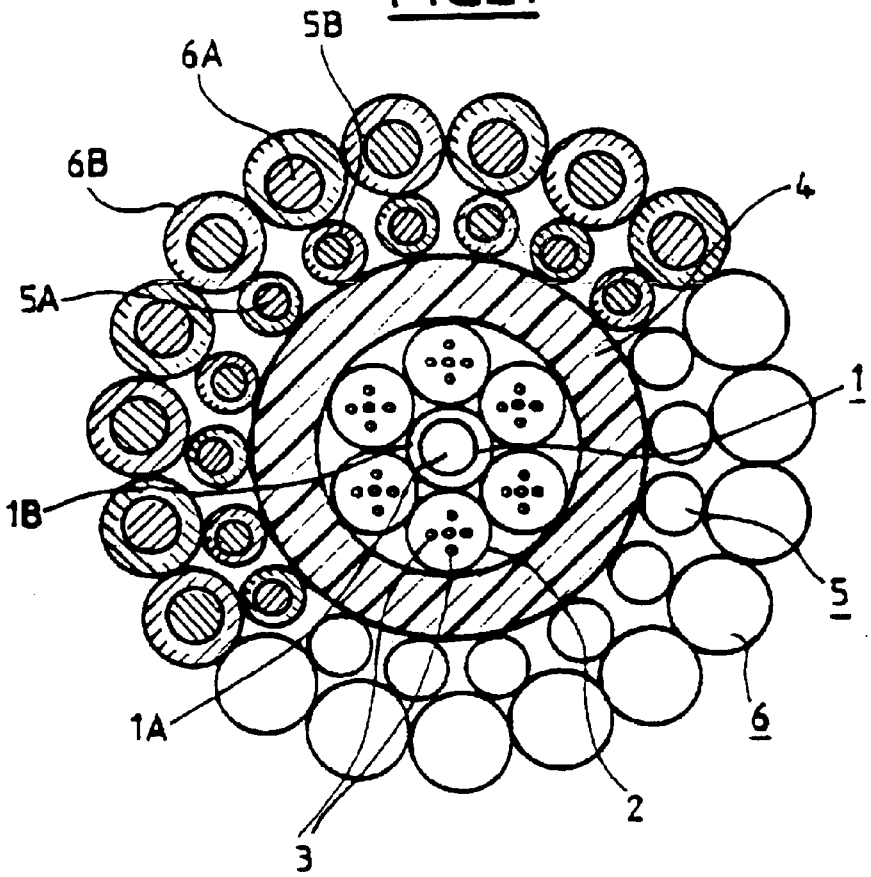
FIG. 1 is a cross-section view of an example of a telecommunications cable of reinforced structure.

The telecommunications cable shown by way of example in cross-section in FIG. 1 is an overhead optical fiber cable, known as an optical guard cable, of the kind used in high voltage electricity distribution networks for remote surveillance, remote control, and/or telecommunications purposes. It is designed to be carried by the pylons of the electrical power transport grid and consequently it can be subjected to severe climatic conditions.

The guard cable has a central reinforcing wire 1 around which tubes 2 are laid, each housing a group of optical fibers 3. The laid tubes are then placed between the central reinforcing wire 1 and a holding tube 4. This tube is usually made of metal, of metal alloy, or of a plastics material.

The tubes 2 are laid either parallel to the central reinforcing wire 1, or else they are wound helically thereabout.

Armoring is placed around the holding tube 4. In this case it is made up of two layers of wires 5 and 6 that touch each other and that are of different diameters in the two layers.

In accordance with the invention, at least some of these armoring wires are made of a composite steel. Wires made of composite steel may optionally be interposed between wires made of aluminum alloy. The outer layer of armoring can also be made entirely out of aluminum alloy. Each composite steel wire has a core 5A or 6A made out of a standard type of steel and covered in a layer 5B or 6B of stainless steel. The same applies in this case to the central reinforcing wire 1 which comprises a core 1A covered in a layer 1B.

By way of example, the composite steel used is a steel manufactured by STELAX under the registered trademark NUOVINOX, it is obtained from tubes of stainless steel filled with ground steel particles which are compressed under high pressure inside the tubes. The billets obtained from such tubes are then placed in a furnace which is raised to a temperature of 1250° C., after which they are drawn into the form of wires of respective sections corresponding to those desired for the reinforcing wires and/or the armoring wires.

This makes it possible to obtain wires whose peripheries withstand corrosion as well as a wire made of solid stainless steel, but to do so at a cost that is considerably lower. The stainless steel layer on the composite steel wire corresponds, for example, to a skin having a thickness of 0.5 mm. The core of a composite steel wire can optionally have mechanical strength that is greater than that of the stainless steel, for example if the core is made out of a high strength carbon steel.

In the example of a cable shown in FIG. 1, it is assumed that the central reinforcing wire 1 and the wires 5 and 6 in the armoring layers are made out of composite steel so as to benefit both from the advantages concerning mechanical strength that are provided by said steel and from the absence of any hydrogen being given off which is desirable because of the presence of optical fibers in the cable.

Naturally, it is possible to make other telecommunications cables in which advantage can be taken of using a composite steel for reinforcing wires or for armoring wires, and in particular telecommunications cables having wires or coaxial waveguides of electrically conductive material for transmitting signals in electrical form.

Figure 2:
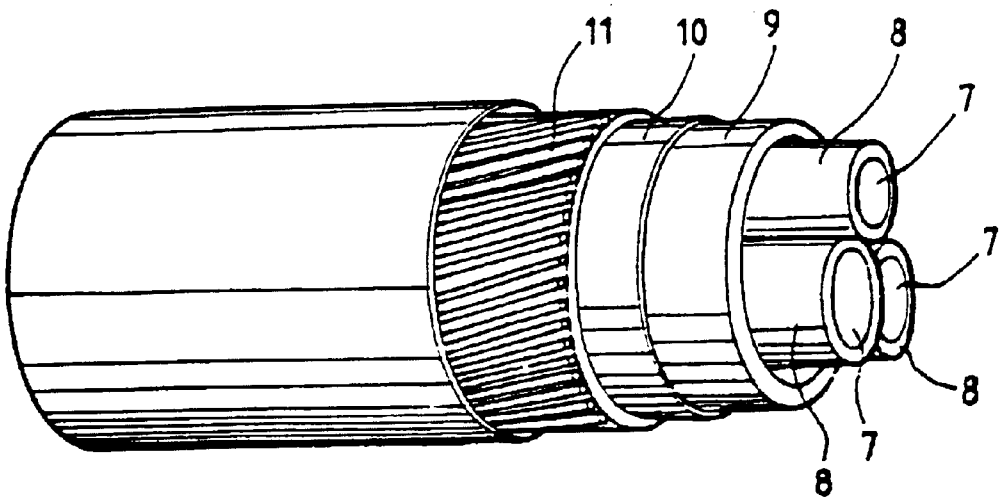
FIG. 2 is a view of a segment of a power transport cable of reinforced structure.

FIG. 2 shows an example of a segment of armored power distribution cable which comprises in its center three multistrand power distribution conductors 7, e.g. made of copper, each of said conductors being covered in an insulating sheath 8. The assembly is housed in a sheath 9 which forms a cushion, and which is covered by a sheet 10 that optionally be made of a composite steel such as NUOVINOX.

The tube formed by the sheet 10 is itself covered in a layer of armoring, in this case a single layer, constituted by wires 11 that are laid parallel with or helically around the tube. At least some of the armoring wires are made of composite steel, and preferably of NUOVINOX, for mechanical reinforcement purposes, like the armoring of the telecommunications cable shown in FIG. 1.

What is claimed is:

1. A telecommunications or power transport cable that is structurally reinforced by incorporating armoring having one or more layers of wires, wherein said one or more layers of wires includes a composite steel wire having a core steel of a standard type, and covered in a layer of stainless steel that defines a continuous layer of uniform thickness, density, and composition, and wherein said one or more layers of wires do not carry electricity.

2. A telecommunications or power transport cable according to claim 1, in which at least one layer of wires from said one or more layers of wires is constituted by composite steel wire.

3. The telecommunications or power transport cable according to claim 1, wherein said layer of stainless steel of said composite steel wire in said armoring directly contacts the core of steel of said composite steel wire so as to form a two layered structure.

4. A telecommunications or power transport cable that is structurally reinforced by incorporating armoring having one or more layers of wires, wherein said one or layers of wires includes a composite steel wire having a core steel of a standard type, and covered in a layer of stainless steel, and wherein said one or more layers of wires do not carry electricity; and wherein said armoring includes at least one wire from said one or more layers of wires that is made of composite steel wire being made from a tube of stainless steel filled with ground steel particles that are compressed under high pressure within said tube, then placed in a furnace, heated, and drawn to a desired section.

5. A telecommunications or power transport cable that is structurally reinforced by incorporating armoring having one or more layers of wires, wherein said one or layers of wires includes a composite steel wire having a core steel of a standard type, and covered in a layer of stainless steel, and wherein said one or more layers of wires do not carry electricity; and wherein a tube that forms a concentric layer of said cable is provided, wherein said tube is obtained from a sheet made of composite steel having a steel core of a standard type covered in a layer of stainless steel.

6. A telecommunications or power transport cable according to claim 5, in which said tube that forms a concentric layer of said cable is made of composite steel made from a tube of stainless steel filled with ground steel particles that are compressed under high pressure within said tube, then placed in a furnace, heated and drawn to a desired section.

7. A telecommunications or power transport cable that is structurally reinforced by incorporating at least one reinforcing wire that is made of composite steel wire having a core of steel of a standard type, and covered in a layer of stainless steel that defines a continuous layer of uniform thickness, density, and composition, and wherein said reinforcing wire does not carry electricity.

8. The telecommunications or power transport cable according to claim 7, further comprising a plurality of reinforcing wires including said at least one reinforcing wire, each made of composite steel wire having a core of steel of a standard type, and covered in a layer of stainless steel, said plurality of reinforcing wires forming an armoring layer of said cable.

9. The telecommunications or power transport cable according to claim 7, wherein said layer of stainless steel of said one reinforcing wire directly contacts the core of steel of said one reinforcing wire so as to form a two layered structure.

10. A telecommunications or power transport cable that is structurally reinforced by incorporating at least one reinforcing wire that is made of composite steel wire having a core of steel of a standard type, and covered in a layer of stainless steel, and wherein said reinforcing wire does not carry electricity; and wherein said reinforcing wire is made of composite steel wire being made from a tube of stainless steel filled with ground steel particles that are compressed under high pressure within said tube, then placed in a furnace, heated, and drawn to a desired section.

11. A telecommunications or power transport cable that is structurally reinforced by incorporating at least one reinforcing wire that is made of composite steel wire having a core of steel of a standard type, and covered in a layer of stainless steel, and wherein said reinforcing wire does not carry electricity; the telecommunications or power transport cable further comprising a tube that forms a concentric layer of said cable, wherein said tube is obtained from a sheet made of composite steel having a steel core of a standard type covered in a layer of stainless steel.

12. The telecommunications or power transport cable according to claim 11, in which said tube that forms a concentric layer of said cable is made of composite steel made from a tube of stainless steel filled with ground steel particles that are compressed under high pressure within said tube, then placed in a furnace, heated, and drawn to a desired section.

13. A telecommunications or power transport cable that is structurally reinforced with armoring, the armoring being a tube that forms a concentric layer of the cable, the tube obtained from composite steel having a steel core covered in a layer of stainless steel; and wherein the tube is made of composite steel made from a tube of stainless steel filled with ground steel particles that are compressed under high pressure within the tube, then placed in a furnace, heated, and drawn to a desired section.

* * * * *